US012336596B1

(12) United States Patent
Grimes

(10) Patent No.: US 12,336,596 B1
(45) Date of Patent: Jun. 24, 2025

(54) SHOE TAP SYSTEM

(71) Applicant: Jared Grimes, New York, NY (US)

(72) Inventor: Jared Grimes, New York, NY (US)

( * ) Notice: Subject to any disclaimer, the term of this patent is extended or adjusted under 35 U.S.C. 154(b) by 0 days.

(21) Appl. No.: 19/022,796

(22) Filed: Jan. 15, 2025

(51) Int. Cl.
*A43B 5/12* (2006.01)

(52) U.S. Cl.
CPC ..... *A43B 5/12* (2013.01)

(58) Field of Classification Search
CPC ..... A43B 5/12; A43B 13/36
USPC ..... 36/15, 8.3
See application file for complete search history.

(56) References Cited

U.S. PATENT DOCUMENTS

| | | | | |
|---|---|---|---|---|
| 1,836,624 | A * | 12/1931 | Sothen | A43B 5/12 36/8.3 |
| 2,043,177 | A * | 6/1936 | Kekoni | A43B 21/37 36/36 R |
| 2,179,391 | A * | 11/1939 | Waversack | A43B 5/12 36/73 |
| 3,007,260 | A * | 11/1961 | Stone | A43B 5/12 36/8.3 |
| 3,052,995 | A * | 9/1962 | Merkle | A43B 5/12 36/8.3 |
| 3,081,562 | A * | 3/1963 | Oakley | A43B 5/12 D2/968 |
| 4,936,028 | A * | 6/1990 | Posacki | A43B 13/36 36/15 |
| 5,459,946 | A | 10/1995 | Rayow | |
| 7,434,335 | B2 | 10/2008 | Feldstein | |
| 7,984,569 | B2 | 7/2011 | Chaney et al. | |
| 8,356,426 | B1 | 1/2013 | Daniel et al. | |
| 8,544,189 | B2 | 10/2013 | Chaney et al. | |
| 10,251,444 | B2 | 4/2019 | Corbett | |
| 11,071,346 | B2 * | 7/2021 | Adamson | A43B 13/122 |
| 2004/0064971 | A1 * | 4/2004 | Isackson | A43B 5/12 36/8.3 |
| 2004/0168347 | A1 * | 9/2004 | LeVine | A43B 21/36 36/8.3 |
| 2004/0221486 | A1 * | 11/2004 | Dennison | A43B 13/36 36/31 |
| 2005/0138840 | A1 * | 6/2005 | Feldstein | A43B 5/12 36/8.3 |
| 2009/0158619 | A1 | 6/2009 | Wittmers | |
| 2012/0260523 | A1 | 10/2012 | Campbell | |

(Continued)

FOREIGN PATENT DOCUMENTS

| | | | |
|---|---|---|---|
| CA | 2879125 | A | 4/2014 |
| CN | 117223932 | | 12/2023 |
| WO | 2007079591 | A1 | 7/2007 |

*Primary Examiner* — Ted Kavanaugh
(74) *Attorney, Agent, or Firm* — Gordon & Jacobson, P.C.

(57) ABSTRACT

A tap dance shoe system is provided including a shoe having a sole. In an embodiment, the sole has a plurality of first fastener holes and at least one channel intersecting the first fastener holes. A shoe tap includes hole. A fastener includes a shaft with a cross hole. The fastener extends through the tap hole to compress the tap against the shoe sole. A pin extends within the channel of the sole and through the cross hole to prevent the fastener from unintended backout. In another embodiment, the sole has a plurality of slots and a channel intersecting one of the slots. A shoe tap includes bracket with a hole. The bracket is inserted into the slot. A pin extends within the channel of the sole and through the hole in the bracket to secure the tap. The pin can include a head usable for percussive purposes in dance.

9 Claims, 4 Drawing Sheets

(56) References Cited

U.S. PATENT DOCUMENTS

| | | | |
|---|---|---|---|
| 2013/0019504 | A1 | 1/2013 | Kim |
| 2018/0007998 | A1 | 1/2018 | Johnson |
| 2024/0114994 | A1 | 4/2024 | Ryan et al. |

* cited by examiner

SHOE TAP SYSTEM

BACKGROUND OF THE INVENTION

1. Field of the Invention

The present disclosure relates to footwear and footwear accessories. More particularly, the present disclosure relates to footwear for dance and accessories for such footwear, namely taps for shoes.

2. State of the Art

Tap dancing is an indigenous American dance form, with roots in both West Africa and Irish musical and step dance traditions. In tap dance, sound is made by shoes that have a metal "tap" installed on the heel and toe of the shoes. Contemporary tap dance has developed into two major forms: jazz tap, focused on musicality and rhythm, and Broadway tap, focused on dance.

A tap dancer creates sounds by repeatedly and rhythmically striking the taps on their tap shoes with percussive force against a hard surface. Some tap dance moves may involve spinning on the taps of the tap shoes, or temporarily applying the dancer's body weight to the edges of the taps.

Because tap dancers can generate strong vibrations and shock waves within their taps due to repetitive forces applied to the taps during their dance routines, the fasteners, typically screws, that attach the taps to the leather soles of the shoes may eventually break or become loose and back out, and any supplemental adhesives utilized to keep the taps and/or screws in place may fail. In addition, the holes in the leather soles of the shoes may become worn and stripped and no longer able to retain the fasteners when subject to the repetitive vibrations, shock, and impact they receive, again permitting the screws and taps to loosen and fail.

SUMMARY

Tap systems are provided for coupling taps to a pair of shoes in a secure manner. In embodiments, the tap systems may provide structure for additional percussive sounds.

In one embodiment, a tap system includes a heel tap and a toe tap, and two sets of pairs of pins. The heel tap and toe tap may be different shapes and/or sizes for appropriate fit at the heel and toe of the shoe, respectively, as well as for individualized sound performance. Each of the heel tap and toe tap includes a base portion with a plurality of brackets oriented substantially perpendicular to the base portion, and at least one hole extending through the bracket. In an embodiment, the base portion of each of the heel tap may be standard or other known shape, or may be another shape. The base of the heel tap is provided with three brackets: a first bracket provided at a first end of the tap, and second and third brackets oriented transverse to the first bracket, and situated parallel and across from each other at or near an opposite end of the tap. The base portion of the toe tap is also provided with three brackets: a fourth bracket provided at a first end of the tap, and fifth and sixth brackets oriented transverse to the fourth bracket, and situated parallel and across from each other at or near an opposite end of the toe tap. Each of the toe tap brackets includes at least one hole.

The heel and sole at the toe of each shoe include a plurality of slots sized and arranged to closely receive the brackets of the taps. For the heel area, a first slot is situated at the back of the heel, and second and third slots on opposite sides of the heel toward the midsole. In addition, the heel includes channels. A first channel extends into the back of the shoe heel, through the first slot and into the material of the shoe heel; optionally the first channel extends completely through the shoe heel. A second channel extends into the side of the shoe heel from the inner side of the shoe (the side facing the other shoe of a pair of shoes), through the second slot, the material of the shoe heel, into the third slot and then into the material of the shoe heel between the third slot and the outer portion of the heel. Optionally, the second channel extends completely through to the outside of the heel. The first and second channels are oriented at an angle relative to each other and, in a preferred construction, preferably perpendicular relative to each other. The first channel may optionally cross in space beyond the path of the second channel; however, it would then extend at a different elevation through the heel so that the first and second channels do not intersect.

For the toe area of the sole, a fourth slot is situated at the front of the toe in the sole, and fifth and sixth slots are displaced on the sides of the toe further back in the direction of the midsole. In addition, toe area of the sole of the shoe include third and fourth channels. The third channel extends from the toe back toward the midsole. The fourth channel extends into the side of the toe of the sole from the inner side of the shoe (the side facing the other shoe of the pair of shoes), through the fifth slot, the material of across the material of the sole, through the sixth slot and then into the material of the toe of the sole at the outer side of the toe. Optionally, the fourth channel extends completely through to the outerside of the sole. The third and fourth channels are oriented at an angle relative to each other and, in a preferred construction, preferably perpendicular relative to each other. The third channel may optionally cross in space beyond the path of the fourth channel; however, it would then extend at a different elevation through the sole so that the third and fourth channels do not intersect.

A plurality of pins are provided with lengths and diameters suitable for stably and securely extending within the channels and through the holes in the brackets. In use, the heel tap is fixed relative to the heel of the shoe by inserting the first, second and third brackets into the first, second, and third slots, respectively, at the heel of the shoe. Then, a first pin is passed through the first channel engaging the hole in the first bracket; and a second pin is passed through the second channel engaging the holes in the second and third brackets. The fit between the first pin, first channel and hole in the first bracket, and the second pin, second channel and holes in the second and third brackets locks the heel tap relative to the heel of the shoe. Similarly, the toe tap is fixed relative to the toe of the sole of the shoe by inserting the fourth, fifth, and sixth brackets into the first, second, and third slots, respectively, of the heel of the shoe. Then, a third pin is passed through the third channel engaging the hole in the fourth bracket; and a fourth second pin is passed through the fourth channel engaging the holes in the fifth and sixth brackets. The fit between the third pin, third channel and hole in the fourth bracket, and the fourth pin, fourth channel and holes in the fifth and sixth brackets locks the toe tap relative to the heel of the shoe.

In an alternate embodiment, at least one or more of the pins have enlarged heads adapted for percussive engagement with a head on a pin of another shoes, or another surface.

In another embodiment, the soles of the shoes include fastener holes which intersect the channels, rather than the slots. Fasteners are provided having a head and a shaft with a cross-hole through its shaft. The taps have holes corresponding to the fastener holes in the soles. The fasteners are advanced through the taps and into the soles to the preliminarily secure the taps to the shoes. Then pins are advanced through the channels and the cross holes of the fasteners to secure the taps relative to the shoes.

DETAILED DESCRIPTION OF THE PREFERRED EMBODIMENTS

Tap systems are provided for coupling taps to a pair of shoes in a secure manner of dancing. In embodiments, the tap systems may provide structure for additional percussive sounds.

For each of the left and right shoes of a pair of shoes, the tap system includes a heel tap and a toe tap. The heel and toe taps may be different shapes and/or sizes for fit at the heel and toe of the shoe, respectively, as well as possibly for individualized sound performance. All heel and toes taps are shown in an exemplar size, size, and position relative to a shoe sole only for purposes of description herein and should not be construed as any limitation on the scope of the tap systems.

Figure 1:
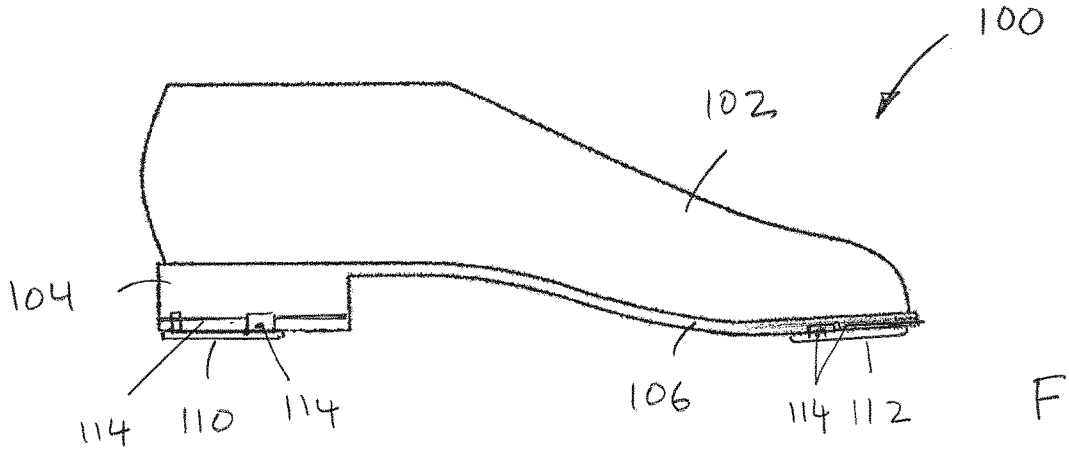
FIG. 1 is a schematic side elevation of a shoe including a first embodiment of a tap system.
Figure 2:
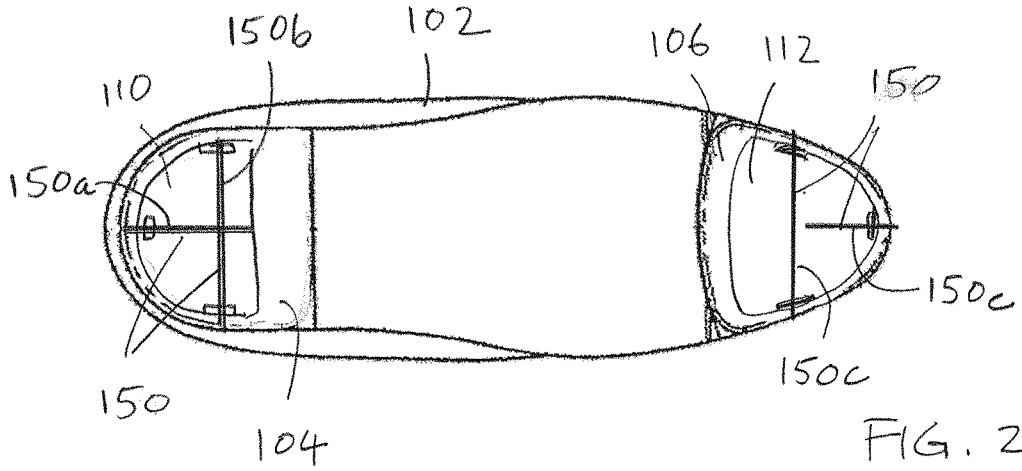
FIG. 2 is a schematic bottom view of the shoe with tap system of FIG. 1.

Referring to FIGS. 1 and 2, a first tap system 100 is shown which includes a shoe 102 having a sole with a heel 104 and toe 106, a heel tap 110, a toe tap 112, and a set of pins 150.

Figure 5:
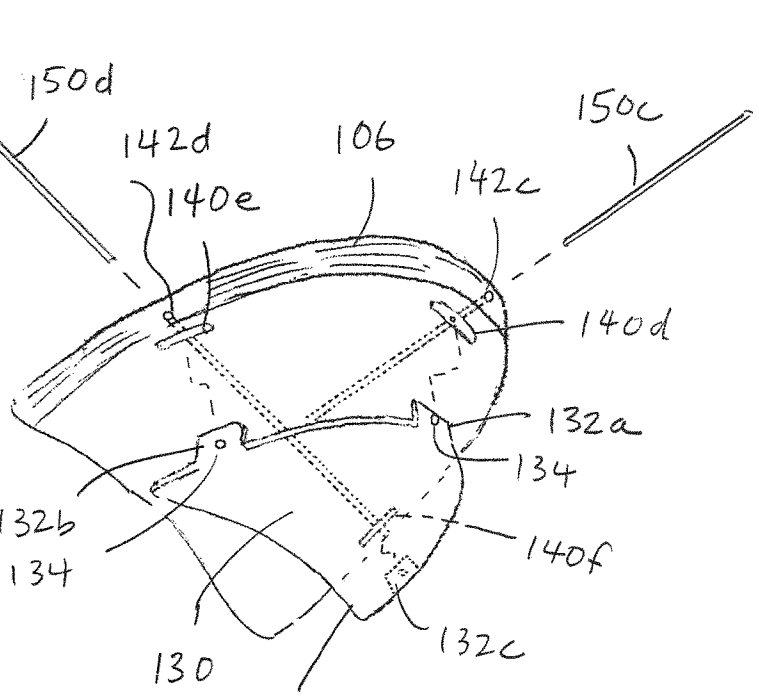
FIG. 5 is a bottom perspective assembly view of a toe of the shoe of FIG. 1.
Figure 3:
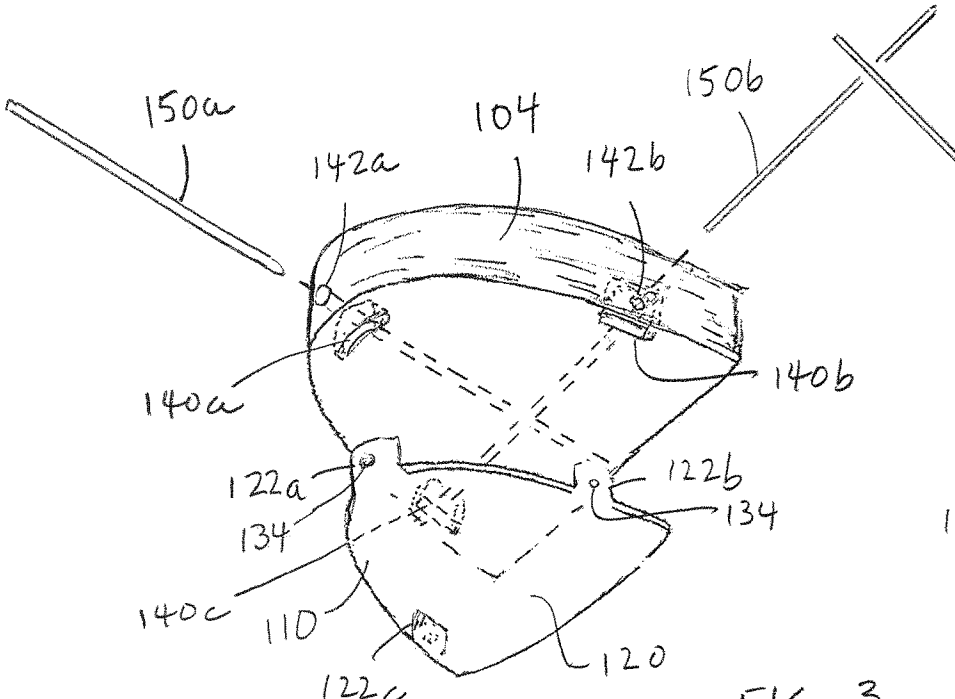
FIG. 3 is a bottom perspective assembly view of a heel of the shoe of FIG. 1.
Figure 4:
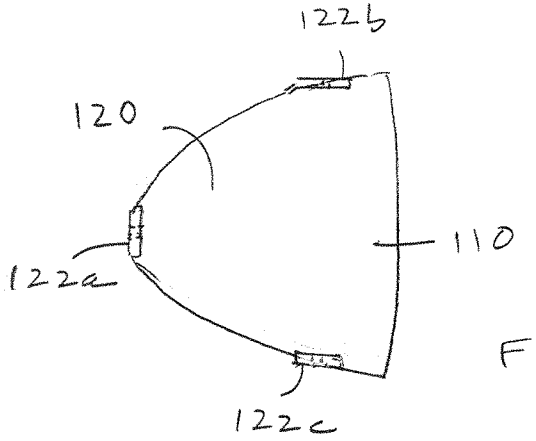
FIG. 4 is a top view of a heel tap for assembly in the system shown in FIG. 3.

Turning to FIGS. 3, 4 and 5, the heel tap 110 includes a base portion 120 with a plurality of brackets 122 oriented substantially perpendicular to the base portion 120. The base portion 120 of the heel tap may be any suitable shape, such as those known in the art or other. The base portion 120 of the heel tap 110 is preferably provided with three brackets: a first bracket 122*a* is provided at a first end of the heel tap 110, and the second and third brackets 122*b*, 122*c* are oriented transverse to the first bracket 122*a* and situated parallel and across from each other at or near an opposite end of the heel tap.

The toe tap 112 includes a base portion 130 which may have any suitable shape, such as those known in the art or other. The base portion 130 is preferably provided with three brackets: a fourth bracket 132*a* provided at a first end of the toe tap, and fifth and sixth brackets 132*b*, 132*c* oriented transverse to the fourth bracket 132*a*, and situated parallel and across from each other at or near an opposite end of the toe tap. Each of the brackets in the heel tap 110 and toe tap 120 is provided with at least one hole 134. The brackets may be of a same size or of different sizes.

The heel 104 and toe 106 of the sole of the shoe include a plurality of slots sized and arranged to closely receive the brackets 122, 132 of the taps. For the heel area, a first slot 140*a* is situated at the back of the heel, and second and third slots 140*b*, 140*c* are displaced on opposite sides forward on the heel toward the midsole. In addition, the heel area includes channels. A first channel 142*a* extends into the back of the heel 104, through the first slot 140*a*, into the material of the heel, and preferably completely through the heel. A second channel 142*b* extends into the side of the heel 104 preferably from the inner side of the shoe (the side facing the other shoe of the pair of shoes), through the second slot 140*b*, the material of the heel, into the third slot 140*c* and then into and preferably out of the material of the heel between the third slot and the outer portion of the heel. The first and second channels 142*a*, 142*b* are oriented at an angle relative to each other and, in a preferred construction, preferably perpendicular relative to each other. The first channel 142*a* may optionally cross in space beyond the path of the second channel 142*b*; however, it would then extend at a different elevation through the heel so that the first and second channels 142*a*, 142*b* do not intersect.

At the toe 106 of the shoe, a fourth slot 140*d* is situated at the front in the sole, and fifth and sixth slots 140*e*, 140*f* are displaced on the opposite sides of the toe further back in the direction of the midsole. In addition, the toe 106 of the shoe includes third and fourth channels 142*c*, 142*d*. The third channel 142*c* extends from the toe back toward the midsole. The fourth channel 142*d* extends into the side of the toe of the sole from the preferably inner side of the shoe (the side facing the other shoe of the pair of shoes), through the fifth slot 140*e*, the material of across the material of the sole, through the sixth slot 140*f* and then into the material of the toe of the sole at the outer side of the toe. The fourth channel 142*d* preferably extends completely through to the outerside of the shoe. The third and fourth channels 142*c*, 142*e* are oriented at an angle relative to each other and, in a preferred construction, preferably perpendicular relative to each other. The third channel 142*c* may optionally cross in space beyond the path of the fourth channel 142*d*; however, it would then extend at a different elevation through the sole so that the third and fourth channels 142*c*, 142*d* do not intersect. The slots are referred to collectively, by single reference 140, and the channels are referred to collectively, by single reference numeral 142. The slots 140 and channels 142 of the shoe may be integrated into the sole and heel of the shoe construction or may be provided in a sole/heel addon to the shoe, both of which shall be considered features of the shoe for purposes of this description.

Shown at FIG. 2, a plurality of pins are provided to attach the heel and toe taps 110, 112 to each shoe 102. A first pin 150*a* has a length sufficient to extend through the first channel 142*a*. A second pin 150*b* has a length sufficient to extend crosswise through the heel via the second channel 142*b*. A third pin 150*c* has a length to extend through the third channel 142*c* at the toe of the shoe. A fourth pin 150*d* has a length sufficient to extend through the sole within the fourth channel 142*d*. The diameter or structure of each pin is adapted to be stably retained within the channel through which it is intended to be received. The pins may be round, oval, flat, or of other suitable cross-sectional shape. The pins 150*a-d* have a longitudinal stiffness facilitating advancement through the channels in the sole.

The pins 150*a*-150*d* may lodge and be stably maintained in positioned within the channels 142*a-d* for example, by the natural compressive force of the leather, rubber, polymeric, or other heel or toe sole material. The sole material may be in layers, with the channels 142*a-d* formed between one or more layers. Alternatively, the heel 104 or toe 106 of the sole of the shoe 102 may include a receiver adapted to removably secure the end of the first pin. As another alternative, the end of the first pin may be threaded and the receiver may be internally threaded and make threaded engagement with the pin. As yet another alternative, the end of the pin may have a groove, and the receiver may have a spring-loaded head that engages within the groove to capture the pin; the pin can be forced into and out of engagement when sufficient force is applied to overcome the bias of the spring.

In use, the heel tap 110 is fixed relative to the heel 104 of the shoe by inserting the first, second and third brackets 122*a-c* into the first, second, and third slots 140*a-c*, respectively, of the heel 104 of the shoe. Then, the first pin 150*a* is passed through the first channel 142*a* engaging the hole 134 in the first bracket 122*a*; and the second pin 150*b* is passed through the second channel 142*b* engaging the holes 134 in the second and third brackets 122*b*, 122*c*.

Similarly, the toe tap 112 is fixed relative to the toe 106 of the sole of the shoe 102 by inserting the fourth, fifth, and sixth brackets 132*a-c* into the fourth, fifth, and sixth slots 140*d-f*, respectively, at the sole of toe of the shoe. Then, the third pin 150*c* is passed into the third channel 142*c* and through the hole 134 in the fourth bracket 132*a* of the toe tap 112; it is preferably secured within the third channel 142*c* in the same manner as the first pin 150*a* is secured in the first channel 142*a*. The fourth pin 150*d* is passed from the inner side of the sole, through the fourth channel 142*d*, through the holes 134 in the fifth and sixth brackets 132*b*, 132*c*, and secured within the third channel 142*d* in the same manner as the second pin 150*b* is secured in the second channel 142*b*. The fit between the pins 150*a-d*, channels 140*a-d*, and holes in the brackets 122*a-c*, 132*a-c* lock the two taps relative to the shoe.

Figure 6:
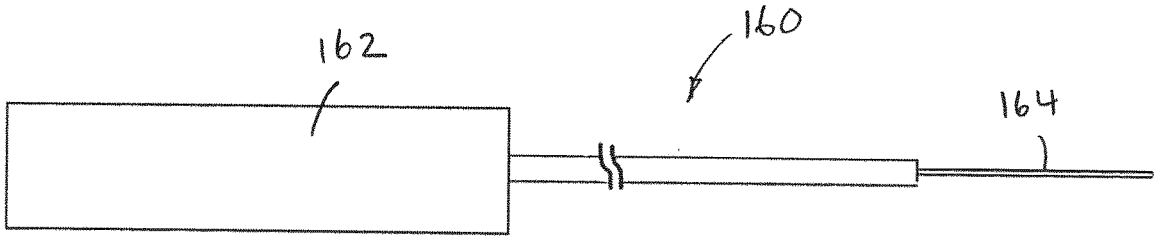
FIG. 6 is a tool to assist in the insertion of the pins of the system of the embodiment shown in FIGS. 1, 2, 3 and 5.

Referring to FIG. 6, a tool 160 is provided to assist with insertion and removal of the pins 150*a-d* into the shoe for assembly and disassembly of the tap system. The tool 160 includes a handle 162 and a pin seat 164. The handle 162 can be manually manipulated and/or impacted by a small mallet or hammer. The pin seat 164 has a size adapted to contact or surround an end of the pins 150*a-d*, as well as be inserted into the channels 140*a-d*. The pin seat 164 can be positioned against the pins 150*a-d* to fully seat the pins within the channels, as well as push advanced through the channels to force the pins completely out of the channel and brackets to thereby release the heel and toe taps from the shoe. While the tool 160 is described for assisting with insertion of the pins, it is understood that the pins may not require a tool for insertion and may be manually insertable and removable.

While taps with preferred locations for the brackets have been described, it is appreciated that more or fewer brackets can be provided to each tap, and that the brackets on each tap can oriented in other configurations relative to each other than as described above. By way of example only, two long parallel brackets can be provided to a tap, with each bracket (and the corresponding channels within the heels and/or soles of the shoe) having multiple holes for receiving multiple pins in either a parallel or skewed orientation. By way of another example, three brackets can be provided to the tap, each obliquely oriented relative to the other and having a hole adapted to receive its own pin. By way of yet another example, one long bracket can be provided with holes adapted to receive two parallel axially offset pins, and one short bracket provided with a hole adapted to receive a third pin oriented transverse to the two pins. It is appreciated that in each variation, the slots and channels of the sole of the shoes are suitably modified to accommodate the brackets and pathway of the pins to assemble the taps. Other variations can be made in accord with the systems described herein.

Figure 7:
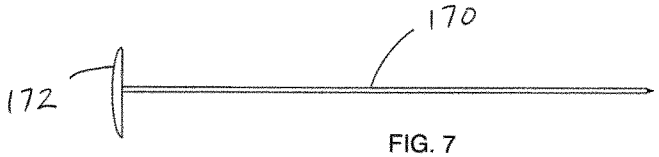
FIG. 7 is a side elevation of an alternate pin for use in the first embodiment.
Figure 7A:
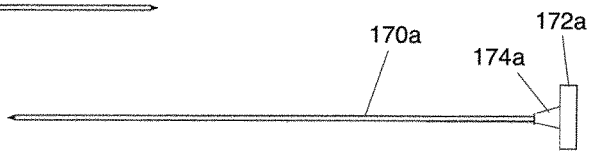
FIG. 7A is a side elevation of another alternate pin for use in the first embodiment.
Figure 10:
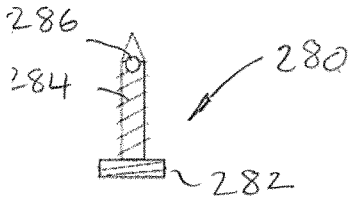
FIG. 10 is a side elevation of a fastener for use in the second embodiment of the tap system.
Figure 11:
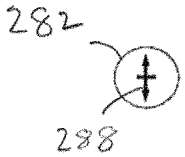
FIG. 11 is a head-end view of the fastener of FIG. 10.

Turning to FIG. 7, in one alternate for the above described system, one or more of the pins 170 may optionally and alternatively include a relatively enlarged rounded tap head 172. The tap head 172 may have a size that prevents its passage through a channel 140*a-d* of the heel or sole of the toe. The tap head 172 may facilitate insertion of the pins into the channels; i.e., by providing a larger surface by which to manipulate the pins. Referring to FIG. 7A, alternatively, the pin 170*a* may include an enlarged flat tap head 172*a*. Either pin 170, 170*a* may have a neck 174*a* of size and shape, e.g., wedge shape, that partially inserts into a channel and functions as a plug. Either tap head 172 may be any suitable shape and material for manual engagement. Additionally and preferably, the tap head also is adapted for percussive engagement with a tap head 172 on a pin 170 installed on an opposite shoe or against a dancing surface. A pair of tap heads 172 can be purposefully brought into contact by the wearer of the shoes to generate a percussive and rhythmic sound. The tap heads may all be made of the same materials as the taps or different materials, and tap heads of different materials can be provided on different shoes or at different locations on a shoe, e.g., at the toe and side of the shoe. Exemplar non-limiting materials for the tap head include aluminum, copper, steal, carbon fiber, plastic and fiber glass.

Turning now to FIGS. 8 through 11, another embodiment of the tap system, similar to tap system 100, with like numbers incremented by 100, is shown. In the system, screws 280 are provided to couple heel tap 210 and toe tap 212 to a shoe 202. Screws 280 have a head 282, a threaded shaft 284, and cross hole 286 extending diametrically across the shaft 284 preferably at the end of the shaft. The head 282 may include indicia 288, such as an arrow, to identify the opening direction of the cross hole 286. The taps 210, 212 have holes 290 in their respective base portions 220, 230 to receive the screws 280. The heel and toe of the shoes also include screw holes 292 in which to receive the shafts of the screws and the channels in which to receive the previously described pins 150, 170. Each channel 242*a*, 242*b*, 242*c*, 242*d* intersects with at least one hole 292.

Figure 12:
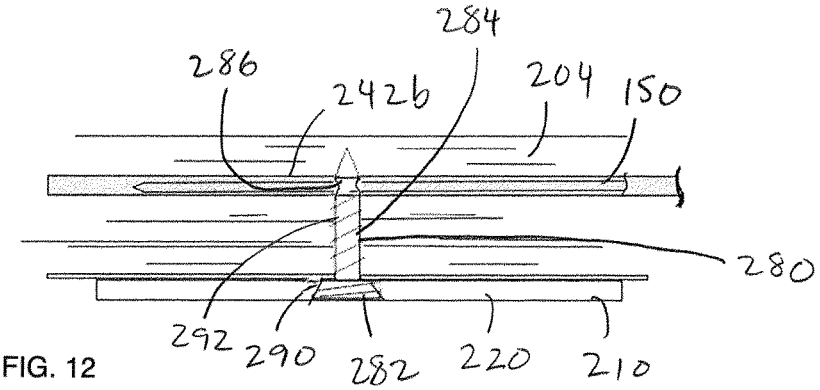
FIG. 12 is a section view assembly of the shoe sole, tap, fastener and pin of the second embodiment of the tap system.

Referring to FIG. 12, in assembly (shown with respect to heel tap 210 but with assembly be substantially the same for toe tap 212), the tap 210 is positioned against the heel and the shafts 284 of the screws are advanced through the holes 290 and into engagement with the material surrounding the holes 292. A Philips head or other driver may be used to drive the screw into engagement. The screws are advanced until the heads 282 provide compressive engagement of the tap 210 against the heel 204. The screw is then rotated, if necessary, to orient the cross hole 286 parallel with its intersecting channel, e.g., channel 242*b*. Then a pin 150 (or 170) is advanced through the channel 142*b* and through the cross hole 286 of the screw 280 to lock the tap 210, screw 280 and 150 (or 170) pin relative to the shoe. The natural compression of the heel material prevents backout of the pin. Other systems may be provided to receive and releasably secure the pin.

Alternatively, another type of fastener instead of a screw, such as a peg, i.e., without a threaded shaft, retained in the heel or sole of the shoe via engagement with the pin extending through its cross-hole. Or, the screw hole and screw head may be threaded and clocked to orient the screw hole at the intended direction relative to its channel when the screw head is in full threaded engagement. Other mechanisms, such as those described above, can be used to secure the position of the pin within the sole of the shoe until it is intended to release the tap from the shoe.

Figure 13:
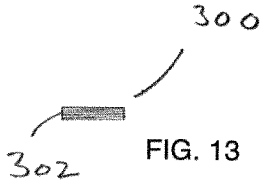
FIG. 13 is a side elevation of a cap for use in an alternate second embodiment of the tap system.
Figure 16:
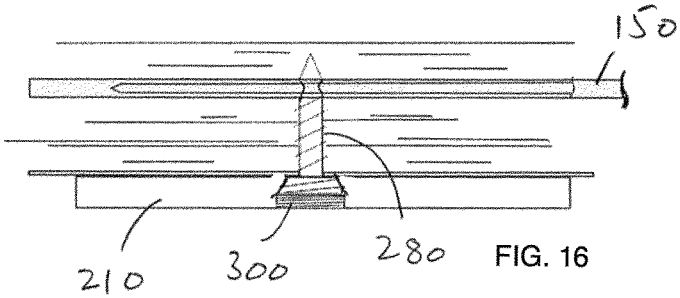
FIG. 16 is a section view assembly of the shoe sole, tap, fastener, cap, and pin of the alternate second embodiment of the tap system.
Figure 14:
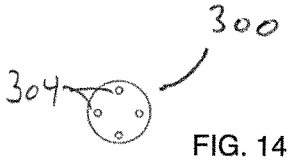
FIG. 14 is an end view of the cap of FIG. 13.
Figure 15:
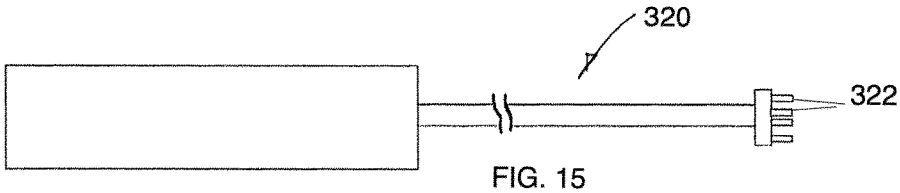
FIG. 15 is a tool for driving the cap into a fastener hole of the tap.
Figure 9:
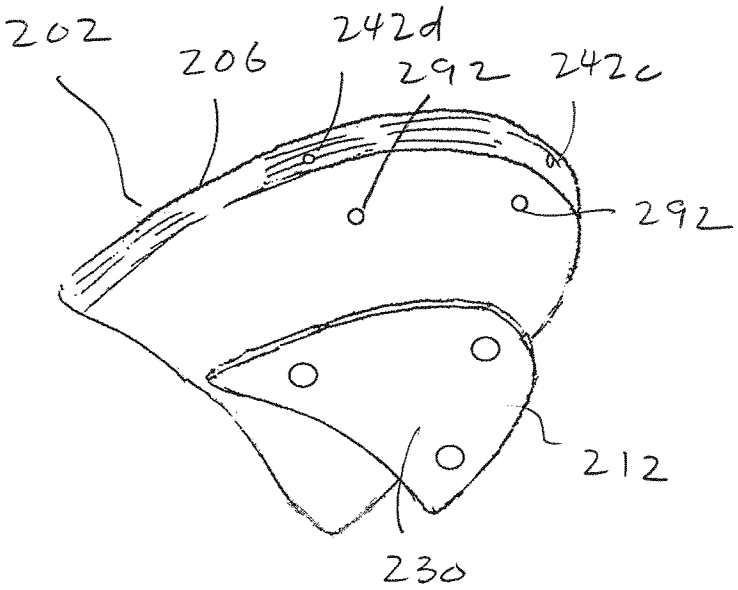
FIG. 9 is a bottom perspective partial assembly, showing a shoe toe and toe tap of the second embodiment of the tap system.
Figure 8:
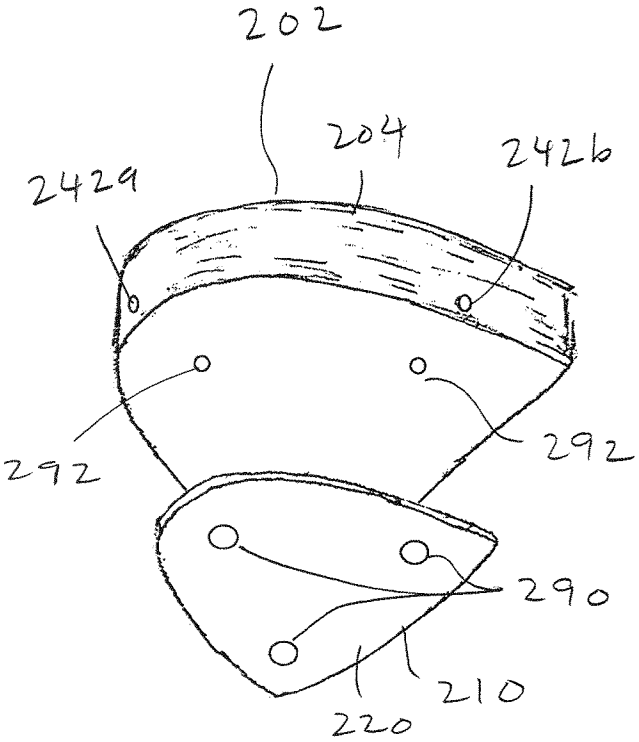
FIG. 8 is a bottom perspective partial assembly, showing a shoe heel and heel tap of a second embodiment of a tap system.

Turning now to FIGS. 13 and 14, a screw cap 300 may be provided for use in association with the tap fasteners 280 to prevent their backout. In systems using a screw cap, the screw holes 290 in the taps 210, 212 are threaded. The screw cap 300 is a disc like member with an external thread 302 adapted to be threadedly received in the threaded screw holes 290. The screw cap 300 can be thin, and have a low profile engagement structure 304. By way of example, the engagement structure can be a non-axially positioned, such as peripherally displaced holes. Referring to FIG. 15, a driver 320 with a non-axially positioned prongs 322 or other features at its end located to engage the holes 304 of the screw cap 300 and provide a rotational force for inserting and removing the screw cap 300. As shown in FIG. 16, after the screws 280 are inserted relative to the tap 210 (or 212), the screw cap 300 can be threadedly engaged within the screw hole to prevent backout of the screw. The screw cap 300 can be used in systems in which pins are used 150 to secure the screws, as well as in those without pins and function as the primary manner to prevent screw backout.

There have been described and illustrated herein several embodiments of a shoe tap system and a method of installing and removing taps from shoes. While particular embodiments of the invention have been described, it is not intended that the invention be limited thereto, as it is intended that the invention be as broad in scope as the art will allow and that the specification be read likewise. It will therefore be appreciated by those skilled in the art that yet other modifications could be made to the provided invention without deviating from its scope as claimed.

What is claimed is:

1. A tap dance shoe system, comprising:

a) a shoe having a sole with heel and toe portions, the sole having slots and channels;

b) a shoe tap having a base and a plurality of brackets oriented at an angle relative to the base, each of the brackets having a hole, the brackets received in the slots; and c) a plurality of pins extending through the channels and through the holes in the brackets to retain the shoe tap relative to the sole.

2. The tap dance shoe system of claim 1, wherein the sole is made of leather, and the slots and channels are provided in the leather.

3. The tap dance shoe system of claim 1, wherein one pin extends through the hole in two brackets.

4. The tap dance shoe system of claim 1, wherein the plurality of pins each have a non-round cross-sectional shape.

5. The tap dance shoe system of claim 1, wherein the pin has an enlarged head that does not fit through the channel.

6. The tap dance shoe system of claim 1, wherein the pin has an enlarged head that partially fits within an end of the channel.

7. The tap dance shoe system of claim 6, wherein the enlarged head is adapted for percussive effect with another enlarged head on an opposite shoe having a same tap dance shoe system.

8. The tap dance shoe system of claim 6, wherein the enlarged head is adapted for percussive effect with a surface separate from the shoe.

9. The tap dance shoe system of claim 1, wherein the shoe tap has exactly three brackets, each with one hole, exactly two pins are provided, and the hole of each of the brackets receives a portion of one of the pins.

* * * * *